US007533515B1

(12) United States Patent
Koskela

(10) Patent No.: US 7,533,515 B1
(45) Date of Patent: May 19, 2009

(54) FILM DELIVERY DEVICE AND USE OF SAME

(75) Inventor: Janne Koskela, Turku (FI)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 12/292,182

(22) Filed: Nov. 13, 2008

(30) Foreign Application Priority Data

Nov. 13, 2007 (FI) ..... 200775802
Oct. 21, 2008 (FI) ..... 20085995

(51) Int. Cl.
*B65B 11/04* (2006.01)
*B65B 53/00* (2006.01)

(52) U.S. Cl. ..... 53/556; 53/588; 100/27; 242/597.8

(58) Field of Classification Search ..... 100/13, 100/27; 53/118, 211, 441, 556, 587, 588; 242/419.6, 419.8, 550, 566, 597.7, 597.8, 242/615.2
See application file for complete search history.

(56) References Cited

U.S. PATENT DOCUMENTS 4,706,443 A * 11/1987 Humphrey ..... 53/556
5,414,979 A * 5/1995 Moore et al. ..... 53/556
5,875,616 A 3/1999 Paavola et al.
6,082,081 A 7/2000 Mucha
7,107,743 B2 * 9/2006 Suolahti ..... 53/556
7,178,317 B1 2/2007 Koskela
2007/0204565 A1 * 9/2007 Lancaster et al. ..... 53/399

* cited by examiner

*Primary Examiner*—Jimmy T Nguyen
(74) *Attorney, Agent, or Firm*—Law Offices of Steven W. Weinrieb

(57) ABSTRACT

A film delivery device comprising a first assembly which can be connected to a wrapping machine and a second assembly (5) which is pivoted to turn, relative to the first assembly (4), about a horizontal hinge axis (6) between a closed position (I) and an open position (II). A first prestretch roller (7) is in the first assembly (4). A second prestretch roller (8) is in the second assembly (5). The film can be threaded by S-threading between the prestretch rollers (7,8). The second assembly (5) is hinged at the lower end to the lower end of the first assembly (4) to turn about the horizontal hinge axis (6). The second assembly (5) comprises a pivoted and spring-loaded first deflecting roller (22) which is arranged downstream relative to the first prestretch roller (7). In the open position (II) of the second assembly (5), that part of the first deflecting roller (22) which is close to the lower end thereof is resting against the surface of the first prestretch roller (7).

13 Claims, 3 Drawing Sheets

FILM DELIVERY DEVICE AND USE OF SAME

FIELD OF THE INVENTION

Figure 1:
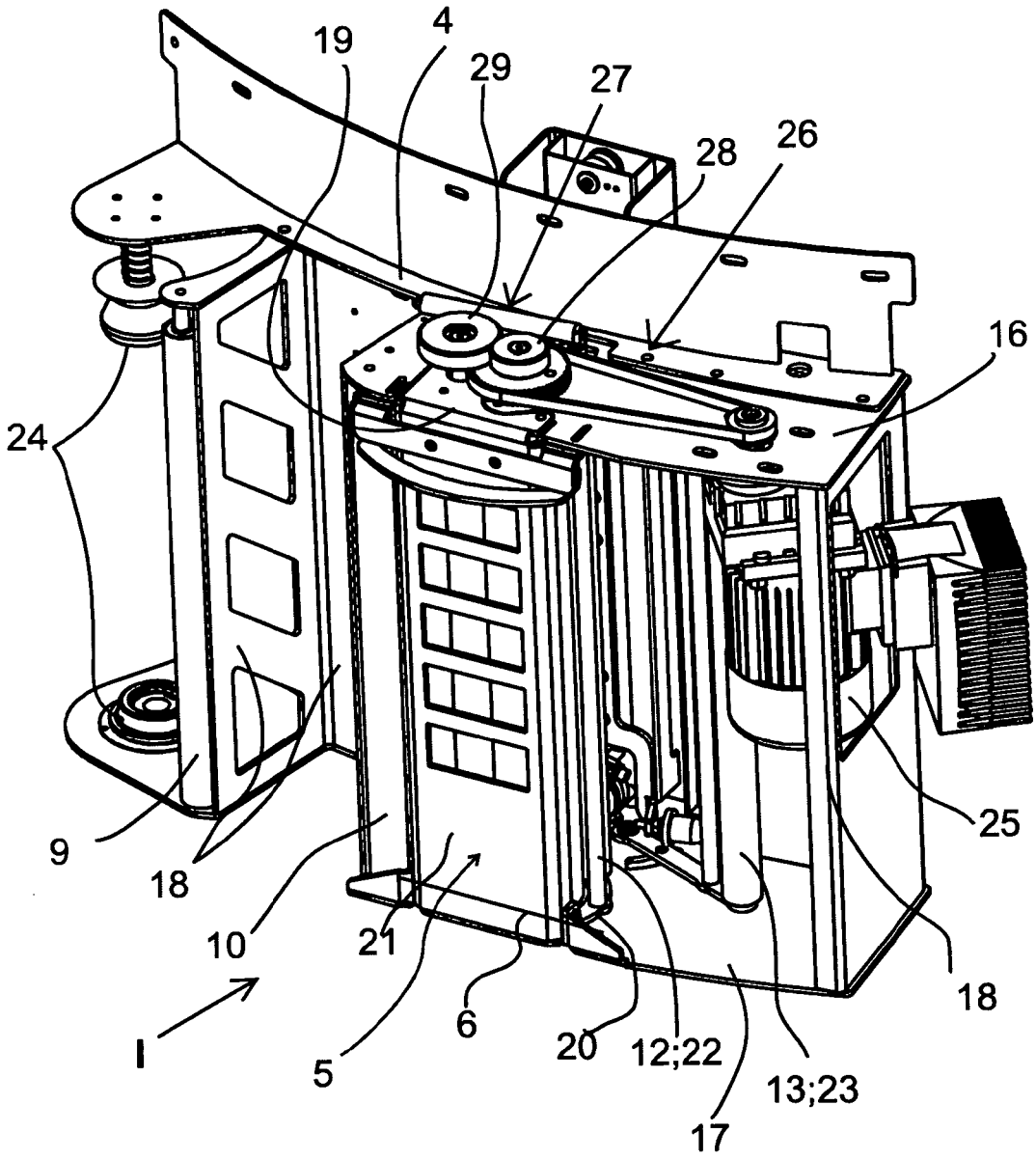

The invention relates to a film delivery device.

BACKGROUND OF THE INVENTION

Previously known from publication U.S. Pat. No. 6,082,081, is a film delivery device for a wrapping machine for delivering a wrapping film around an article to be wrapped up. The film delivery device comprises a first assembly which can be connected to the wrapping machine. Further, the film delivery device comprises a second assembly which is pivoted at the upper end to the upper end of the first assembly to turn about a horizontal hinge axis between a closed position and an open position.

The film delivery device also comprises a prestretch device comprised of two prestretch rollers. It comprises a first prestretch roller which is arranged to the first assembly in substantially vertical direction and arranged to be rotated at a first peripheral speed. Further, the film delivery device comprises a second prestretch roller which is arranged to be rotated at a second peripheral speed which deviates from the first peripheral speed, the second prestretch roller being arranged to the second assembly.

Both assemblies further comprise deflecting rollers for guiding the path of the wrapping film.

When the second assembly is in the closed position, the second prestretch roller is spaced apart from the first prestretch roller so that it is parallel to the first prestretch roller, and the first prestretch roller engages in frictional contact with the first face of the wrapping film and the second prestretch roller engages in frictional contact with the second face of the wrapping film in order to provide a so-called S-threading. An S-shaped threading of the film is known to be advantageous because it provides a large friction surface on the surface of the prestretch rollers. Furthermore, the distance between the points where the film is released from the surface of the upstream prestretch roller and where it contacts the downstream prestretch roller may be short in S-threading.

In the open position, the second assembly is turned, relative to the first assembly, about the hinge axis in such manner that the second prestretch roller is at an angle to the first prestretch roller, so that a gap which opens and widens downwards is provided between the first prestretch roller and the second prestretch roller, in which gap the film can be placed from below when the film roll is being changed.

A problem with the film delivery device known from publication U.S. Pat. No. 6,082,081, which represents the closest prior art, is that it is quite difficult to thread the film into the gap from below, in particular when the new film roll is being changed close to the floor level as is the case in some rotating-arm-type wrapping machines. A further problem is that the axis of the second prestretch roller in the second opening assembly must be pivoted at the upper end, i.e. a hinge joint must be provided between two axes, which impairs the structure and increases production costs. When a high prestretching degree is desired for the film, strong forces are applied to the joint, and hence the joint between the axes has to be dimensioned to be large. Furthermore, said joint makes the structure complex, expensive and vulnerable to malfunction.

Further known from publication U.S. Pat. No. 7,178,317 B1 is a film delivery device in which both prestretch rollers are in the same assembly while the deflecting rollers are in the opening assembly. The first and the second assembly are pivoted to each other at the lower end about a horizontal axis. The film can be easily threaded into the gap that opens upwards, but the prestretch system is not conformable to S-threading, but instead to so-called W-threading in which the prestretch rollers contact the same face of the film. In such construction, the problem relates to the W-threading in which a smaller friction surface is provided on the surface of the prestretch rollers than with S-threading. Furthermore, the distance between the prestretch rollers becomes relatively large with W-threading, resulting in that the wrapping film becomes too narrow. The S-threading is therefore more advantageous. Furthermore, in the construction according to the above-mentioned U.S. Pat. No. 7,178,317, it is difficult to change the degree of prestretching.

OBJECTIVE OF THE INVENTION

The objective of the invention is to eliminate the drawbacks referred to above.

One specific objective of the invention is to disclose a film delivery device which uses S-threading and in which the threading of the film is particularly easy.

A further objective of the invention is to disclose a film delivery device which permits disposition of the film into the gap between the prestretch rollers from above.

Yet another objective of the invention is to disclose a film delivery device which holds heavy loads and uses S-threading, and is furthermore inexpensive, light-weighted and includes less parts than before.

SUMMARY OF THE INVENTION

According to the invention, a second assembly is hinged at the lower end to the lower end of a first assembly to turn about said horizontal hinge axis in such manner that in an open position, a gap opens upwards to allow positioning of a wrapping film into the gap from above. The second assembly comprises a first pivoted deflecting roller which is arranged downstream relative to a first prestretch roller in order to press the wrapping film against the first prestretch roller on the other side relative to the position of a second prestretch roller in such manner that in a closed position of the second assembly, the first deflecting roller is pressed against the first prestretch roller and the wrapping film is deflected on the periphery of the first prestretch roller in substantially opposite direction in order to provide a large contact surface, and in the open position of the second assembly, that part of the first deflecting roller which is close to the lower end thereof is resting against the surface of the first prestretch roller.

The invention provides the advantage that it allows the wrapping film to be disposed into the gap from above, which makes the disposition of the film very easy. Threading the film is further facilitated by the fact that in the open position, the first deflecting roller rests against the downstream first prestretch roller and is not able to move to the front side of the first prestretch roller. Therefore, the first deflecting roller is never able to move to a position from which it should be turned against the spring loading, for example manually, to the second position before it would be possible to close the second assembly to the closed position. By the solution according to the invention, it is simple and easy to feed the end of the film when the film is being loaded. In the open position of the second assembly, the end of the film is simply positioned into the fork between the first prestretch roller and the first deflecting roller. The end of the film may be in almost rope-like form. The second assembly is closed, whereupon the film is pressed between the deflecting roller and the first prestretch roller. Then, the prestretch rollers are rotated, so that they draw the film from the rope-like form to an expanded form. A further advantage is that transmission of force to the second prestretch roller in the second opening assembly may be accomplished without providing joints in the rotating axes. In the invention, the advantageous S-threading of the wrapping film is utilized, which provides a larger friction surface than the W-threading on the surface of the prestretch rollers. Whereas normally in the prior art, generating a larger friction surface has meant complex pivoting in order to turn the deflecting rollers behind the prestretch rollers, in the solution according to the invention, on the other hand, pivoting the deflecting roller which contacts the prestretch roller has been made easy by utilizing the path of the opening movement of the second opening assembly in the setting and final positioning of the deflecting rollers.

In one embodiment of the film delivery device, the first assembly comprises a pivoted second deflecting roller which is arranged upstream relative to the second prestretch roller in order to press the wrapping film against the second prestretch roller on the other side relative to the position of the first prestretch roller in such manner that in the closed position of the second assembly, the second deflecting roller is pressed against the second prestretch roller substantially over the entire length thereof and the wrapping film is deflected on the periphery of the second prestretch roller in order to provide a large contact surface, and in the open position of the second assembly, that part of the second prestretch roller which is close to the lower end thereof is resting against the surface of the second deflecting roller.

In one embodiment of the film delivery device, the first assembly comprises substantially horizontal first upper frame element and first lower frame element spaced in the vertical direction at a distance from the first upper frame element, first intermediate support elements which extend between the first upper frame element and the first lower frame element. The first intermediate support elements are connected at the upper ends to the first upper frame element and at the lower ends to the first lower frame element in order to form a substantially rigid construction, and the first prestretch roller is bearing-mounted at the upper end to the first upper frame element and at the lower end to the first lower frame element. The second assembly comprises a second upper frame element, a second lower frame element at a distance from the second upper frame element, second intermediate support elements which extend between the second upper frame element and the second lower frame element, the second intermediate support elements being connected at the upper ends to the second upper frame element and at the lower ends to the second lower frame element to form a substantially rigid construction. The second lower frame element is hinged to the first lower frame element to turn about the horizontal hinge axis. The second prestretch roller is bearing-mounted at the upper end to the second upper frame element and at the lower end to the second lower frame element.

In one embodiment of the film delivery device, the peripheral speed of the first prestretch roller is greater than the peripheral speed of the second prestretch roller.

In one embodiment of the film delivery device, the first assembly comprises a spring-suspended dancer roller arranged downstream relative to the pivoted deflecting roller.

In one embodiment of the film delivery device, the first assembly comprises a film roll holder.

In one embodiment of the film delivery device, the first assembly comprises a drive motor for rotating the prestretch rollers.

In one embodiment of the film delivery device, it comprises first transmission elements for transmitting the force from the drive motor to the first prestretch roller.

In one embodiment of the film delivery device, it comprises second transmission elements for transmitting the force from the first prestretch roller to the second prestretch roller.

In one embodiment of the film delivery device, the second transmission elements comprise a first cogwheel connected to the upper end of the first prestretch roller and a second cogwheel connected to the upper end of the second prestretch roller, the first and the second cogwheel being fitted to be engaged with each other in a force-transmitting manner when the second assembly is in the closed position and being disengaged from each other when the second assembly is in the open position.

The film delivery device can be advantageously used in a rotating-arm-type wrapping machine in which it is connected to a rotating arm for rotating the film delivery device relative to a stationary article to be wrapped up.

The film delivery device can be advantageously used in a ring-type wrapping machine in which it is connected to a wrapping ring for rotating the film delivery device relative to a stationary article to be wrapped up.

The film delivery device can be advantageously used in a column-type wrapping machine in which it is connected to a stationary column and the article to be wrapped up is rotated on a turntable relative to the film delivery device.

LIST OF FIGURES

Figure 2:
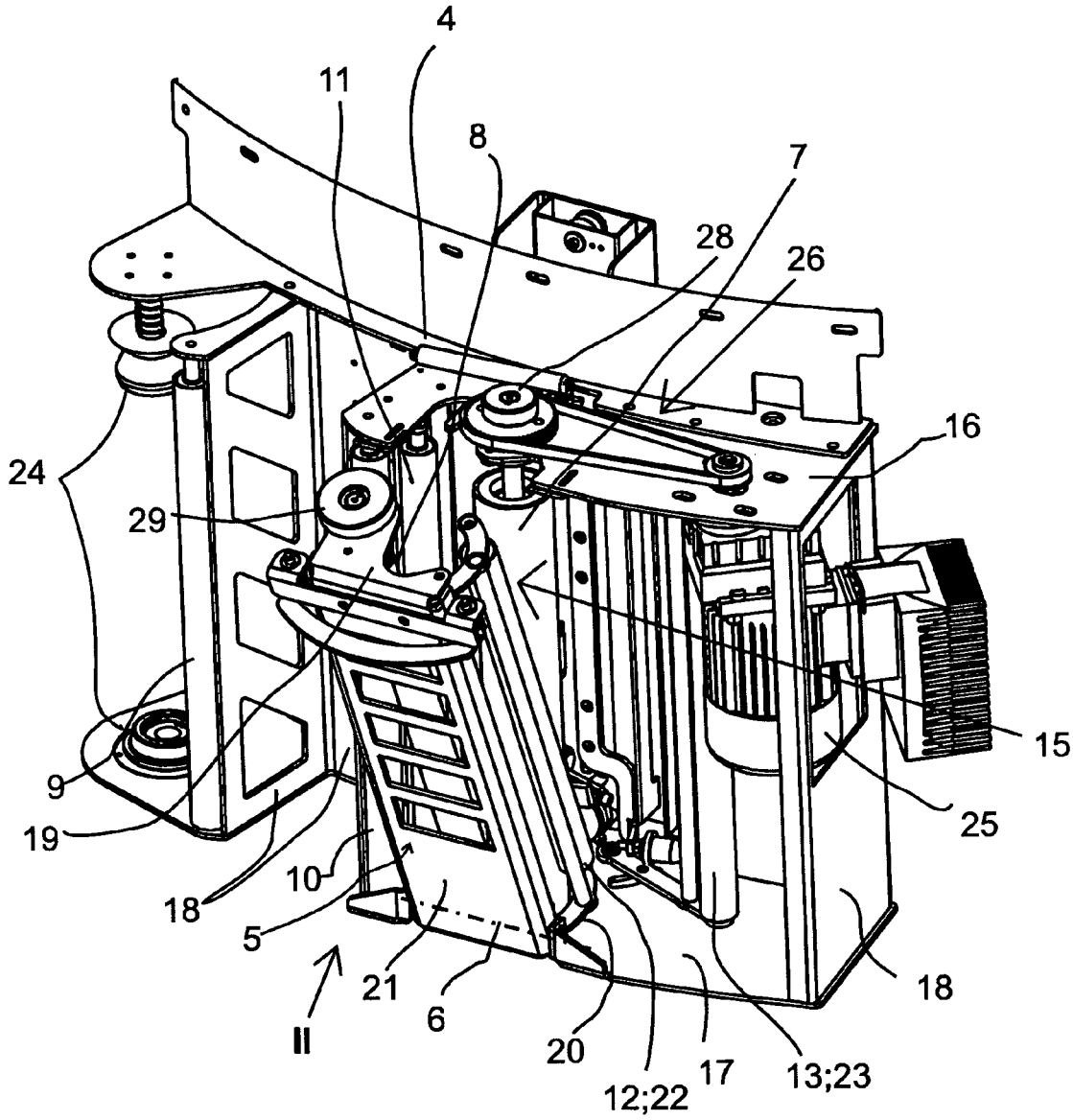
Figure 3:
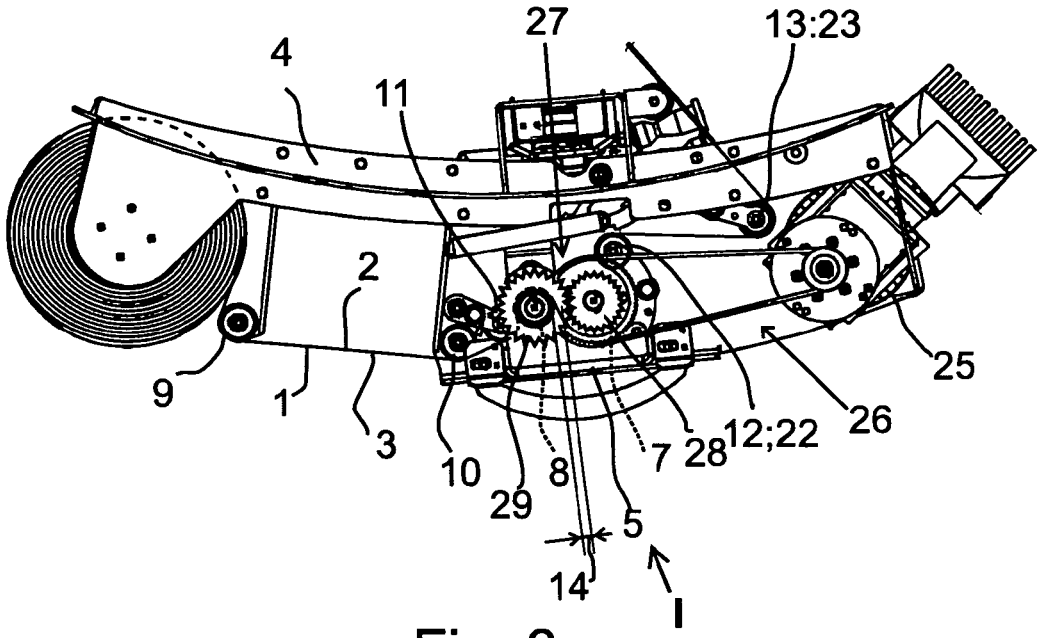
Figure 4:
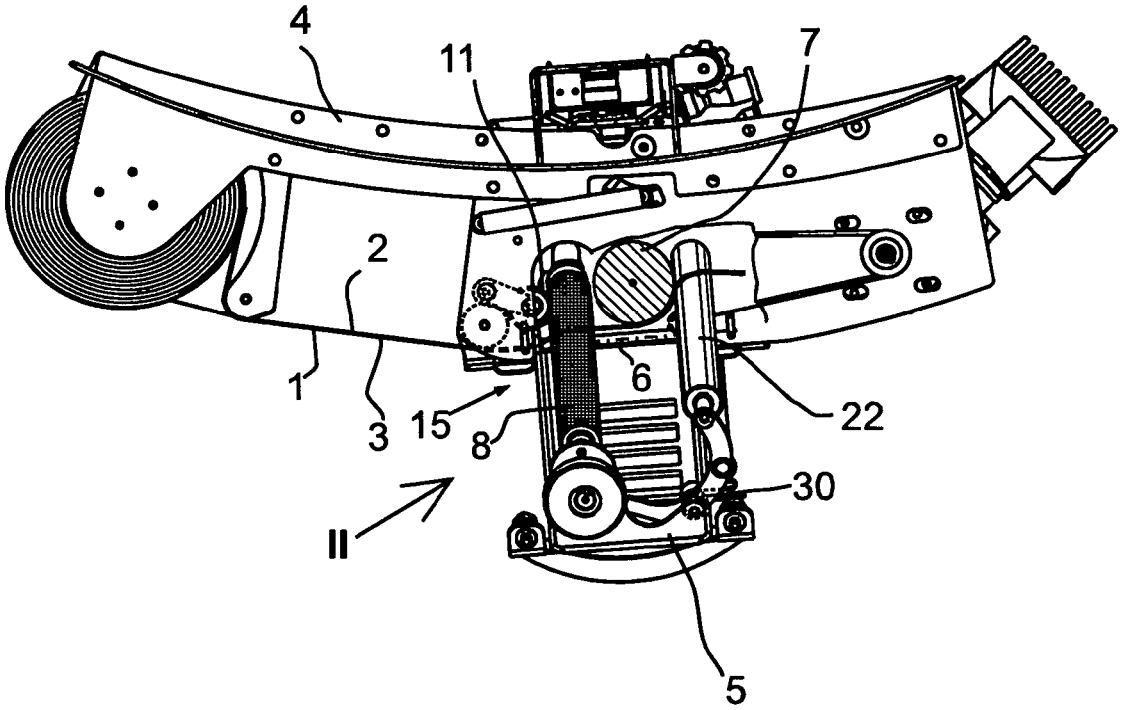

In the following section, the invention will be described in detail by means of exemplifying embodiments with reference to the accompanying drawing in which FIG. 1 presents an axonometric oblique top view of one embodiment of the film delivery device according to the invention in a closed position, FIG. 2 presents the film delivery device of FIG. 1 in an open position, FIG. 3 presents a top view of the film delivery device of FIG. 1, and FIG. 4 presents partly in section a top view the film delivery device of FIG. 2.

DETAILED DESCRIPTION OF THE INVENTION

FIG. 1 to 3 show a film delivery device for a wrapping machine (not shown) for delivering a wrapping film 1 around an article to be wrapped up. FIG. 3 shows that the wrapping film 1 has a first face 2 and a second face 3.

The film delivery device comprises a first assembly 4 which can be connected to the wrapping machine. The wrapping machine in which the presented film delivery device can be used may be any wrapping machine of the known type, such as

- a rotating-arm-type wrapping machine in which the film delivery device is connected to a rotating arm for rotating the film delivery device relative to a stationary article to be wrapped up,
- a ring-type wrapping machine in which the film delivery device is connected to a wrapping ring for rotating the film delivery device relative to a stationary article to be wrapped up, or
- a column-type wrapping machine in which the film delivery device is connected to a stationary column and the article to be wrapped up is rotated on a turntable relative to the film delivery device.

Further, the film delivery device comprises a second assembly 5 which is pivoted at the lower end to turn, relative to the first assembly 4, about a horizontal hinge axis 6 between a closed position I (FIGS. 1 and 3) and an open position II (FIGS. 2 and 4).

A first prestretch roller 7 disposed downstream in the direction of travel of the film is in a substantially vertical direction in the first assembly 4. It is rotated at a first peripheral speed.

A second prestretch roller 8 disposed upstream in the direction of travel of the film is arranged to the second assembly 5 to be rotated at a second peripheral speed which is lower than the peripheral speed of the first prestretch roller.

There are also deflecting rollers 9, 10, 11, 12; 22, 13 on the path of the film, in both the first and the second assembly, for guiding the path of the wrapping film properly.

FIG. 3 shows that when the second assembly 5 is in the closed position I, the second prestretch roller 8 is spaced at a distance 14 from the first prestretch roller 7 and it is parallel to the first prestretch roller, and the first prestretch roller 7 is in frictional contact with the first face 2 of the wrapping film 1 and the second prestretch roller 8 is in frictional contact with the second face 3 of the wrapping, providing an S-threading for the film.

In the open position II of FIGS. 2 and 4, the second assembly 5, hinged at the lower end, is turned, relative to the first assembly 4, about the hinge axis 6 in such manner that the second prestretch roller 8 is at an angle to the first prestretch roller 7 in order to provide a gap 15 which widens and opens upwards between the first prestretch roller 7 and the second prestretch roller 8, facilitating the disposition and threading of the wrapping film from above into the gap 15 that opens upwards between the prestretch rollers 7, 8.

The second assembly 5 further comprises a first pivoted deflecting roller 22 arranged downstream relative to the first prestretch roller 7. The first pivoted deflecting roller 22 is continuously spring-loaded by a spring 30 or by other pressing mechanism towards the first prestretch roller 7. The first pivoted deflecting roller 22 contacts, when the second assembly 5 is in the closed position I of FIGS. 1 and 3, the second face 3 of the wrapping film 1, pressing the wrapping film 1 against the first prestretch roller 7 on the other side relative to the position of the second prestretch roller 8 in such manner that the wrapping film is deflected on the periphery of the first prestretch roller 7 for more than 180°, so that as large friction contact surface as possible is provided between the film 1 and the first prestretch roller 7. When the second assembly 5 is in the closed position I of FIGS. 1 and 3, the first deflecting roller 22 is pressed substantially in line contact against the first prestretch roller 7 over the entire length thereof. In the closed position I, the first deflecting roller 22 is preferably locked in position in such manner that when the film is tightened, it is not able to draw the deflecting roller off the first prestretch roller 7 in such manner that the gripping effect of the deflecting roller 22 would be prevented.

When the second assembly 5 is opened to the open position II of FIGS. 2 and 4, that part of the first deflecting roller 22 which is close to the lower end thereof is resting, in its inclined position and under the pressure of the spring 30, against the surface of the first prestretch roller 7 in point or spot contact from which said gap 15 opens upwards. When the film is being fed in the open position II of the second assembly 5, the end of the film 1 is simply positioned into the fork between the first prestretch roller 7 and the first deflecting roller 22. The end of the film may be in rope-like form. The second assembly 5 is closed whereupon the film is pressed between the first deflecting roller 22 and the first prestretch roller 7. Then, the prestretch rollers 7 and 8 are rotated, drawing the film from the rope-like form to an expanded form.

The first assembly 4 comprises a second pivoted deflecting roller 11 arranged upstream relative to the second prestretch roller 8 in order to press the wrapping film against the second prestretch roller 8 on the other side relative to the position of the first prestretch roller 7. When the second assembly 5 is in the closed position I, the second deflecting roller 11 is pressed (for example through spring-suspension or in other manner) substantially over the entire length thereof against the second prestretch roller 8 and the wrapping film is deflected on the periphery of the second prestretch roller 8 in order to provide a large contact surface. When the second assembly 5 is in the open position II, that part of the second prestretch roller 7 which is close to the lower end thereof is resting against the surface of the second deflecting roller 11.

As seen from FIGS. 1 and 2, the first assembly 4 comprises substantially horizontal first upper frame element 16 and first lower frame element 17 spaced at a distance from the first upper frame element 16 in the vertical direction, and first intermediate support elements 18 which extend between the first upper frame element 16 and the first lower frame element 17. The first intermediate support elements 18 are connected at the upper ends to the upside first upper frame element 16 and at the lower ends to the downside first lower frame element 17 and form all together a substantially rigid construction. The first prestretch roller 7 is bearing-mounted at the upper end to the first upper frame element 16 and at the lower end to the first lower frame element 17.

Correspondingly, the second assembly 5 comprises a second upper frame element 19, a second lower frame element 20 at a distance from the second upper frame element 19, second intermediate support elements 21 which extend between the second upper frame element 19 and the second lower frame element 20, the second intermediate support elements 21 being connected at the upper ends to the second upper frame element 19 and at the lower ends to the second lower frame element 20 to form a substantially rigid construction. The second lower frame element 20 is hinged to the first lower frame element 17 to turn about the horizontal hinge axis 6. The second prestretch roller 8 is bearing-mounted at the upper end to the second upper frame element 19 and at the lower end to the second lower frame element 20.

Further, the first assembly 4 comprises a spring-suspended dancer roller 23 which is arranged downstream relative to the pivoted first deflecting roller 22. The first assembly 4 also comprises a film roll holder 24. In addition, a drive motor 25 for rotating the prestretch rollers 7, 8 is supported on the first assembly 4. First transmission elements 26, which comprise herein a drive belt pulley connected to the drive motor shaft, a cogged belt and a belt pulley connected to the first prestretch roller 7, transmit the force from the drive motor 25 to the first prestretch roller 7.

Second transmission elements 27 which transmit the force further from the first prestretch roller 7 to the second prestretch roller 8 comprise a first cogwheel 28 connected to the upper end of the first prestretch roller 7 and a second cogwheel 29 connected to the upper end of the second prestretch roller 8, the first and the second cogwheel being fitted to be engaged with each other when the second assembly 5 is in the closed position I and to be disengaged when the second assembly 5 is opened to the open position II.

The invention is not limited merely to the exemplifying embodiment referred to above; instead many variations are possible within the scope of the inventive idea defined by the claims.

The invention claimed is:

1. A film delivery device for a wrapping machine for delivering a wrapping film around an article to be wrapped up, wherein the wrapping film has a first face and a second face, and the film delivery device comprises:

a first assembly which is adapted to be fixedly connected to the wrapping machine;

a second assembly pivotally attached at a lower end portion thereof so as to be pivotal with respect to said first assembly about a horizontal hinge axis between a closed position and an open position;

a first prestretch roller mounted upon said first assembly so as to be disposed within a substantially vertical direction and which is arranged to be rotated at a first pre-determined peripheral speed;

a second prestretch roller mounted upon said second assembly and which is arranged to be rotated at a second pre-determined peripheral speed which is different from the first predetermined peripheral speed of said first prestretch roller and which is disposed upstream of said first prestretch roller as considered in a direction of travel of the wrapping film;

a plurality of deflecting rollers mounted upon said first and second assemblies for guiding the wrapping film toward and away from said first and second prestretch rollers;

wherein, when said second assembly is disposed at said closed position, said second prestretch roller will be spaced a predetermined distance from said first prestretch roller, said second prestretch roller will be disposed parallel to said first prestretch roller, said first prestretch roller engages in frictional contact the first face of the wrapping film and the second prestretch roller engages in frictional contact the second face of the wrapping film in order to provide S-threading of the wrapping film through said first and second assemblies, and wherein, when said second assembly is disposed at said open position, said second assembly is pivoted, relative to said first assembly, about said hinge axis such that said second prestretch roller is disposed at an angle with respect to said first prestretch roller so as to provide a gap which opens upwardly so as to facilitate positioning of the wrapping film into said gap from an upward position; and wherein a first roller of said plurality of deflecting rollers is mounted upon a curved arm, and said curved arm is pivotally mounted upon said second assembly, the first roller is disposed downstream of said first prestretch roller as considered in the direction of travel of the wrapping film in order to press the wrapping film against said first prestretch roller on the side of said first prestretch roller opposite to the side of said first prestretch roller which is disposed closest to said second prestretch roller such that when said second assembly is disposed at its closed position, said first one of said plurality of deflecting rollers is pressed against said first prestretch roller over substantially the entire length of said first prestretch roller so as to deflect the wrapping film onto a substantially large peripheral portion of said first prestretch roller in order to provide a large contact surface between the wrapping film and said first prestretch roller.

2. The film delivery device as set forth in claim 1, further comprising:

a second one of said plurality of deflecting rollers mounted upon said first assembly and disposed upstream of said second prestretch roller, as considered in the direction of travel of the wrapping film, so as to engage the side of said second prestretch roller opposite to the side of said second prestretch roller which is disposed closest to said first prestretch roller, when said second assembly is disposed at said closed position, such that when said second assembly is disposed at said closed position, said second one of said plurality of deflecting rollers is pressed against said second prestretch roller over substantially the entire length of said second prestretch roller so as to deflect the wrapping film onto a substantially large peripheral portion of said second prestretch roller in order to provide a large contact surface between the wrapping film and said second prestretch roller.

3. The film delivery device as set forth in claim 2, wherein:

said first and second ones of said plurality of deflecting rollers are respectfully spring-biased into engagement with said first and second prestretch rollers.

4. The film delivery device as set forth in claim 1, wherein:

said first assembly comprises a first substantially horizontally oriented upper frame element, a first substantially horizontally oriented lower frame element spaced a predetermined vertical distance from said first upper frame element, first intermediate support elements which extend between said first upper frame element and said first lower frame element, said first intermediate support elements being connected at upper end portions thereof to said first upper frame element and at lower end portions thereof to said first lower frame element so as to form a substantially rigid construction; and said first prestretch roller is bearing-mounted at the upper end portion thereof to said first upper frame element and at the lower end portion thereof to said first lower frame element.

5. The film delivery device as set forth in claim 1, wherein:

said second assembly comprises a second substantially horizontally oriented upper frame element, a second substantially horizontally oriented lower frame element spaced a predetermined vertical distance from said second upper frame element, second intermediate support elements which extend between said second upper frame element and said second lower frame element, said second intermediate support elements being connected at upper end portions thereof to said second upper frame element and at lower end portions thereof to said second lower frame element so as to form a substantially rigid construction; and said second prestretch roller is bearing-mounted at the upper end portion thereof to said second upper frame element and at the lower end portion thereof to said second lower frame element.

6. The film delivery device as set forth in claim 1, wherein:

said first peripheral speed of said first prestretch roller is greater than said second peripheral speed of said second prestretch roller.

7. The film delivery device as set forth in claim 3, wherein:

said first assembly further comprises a spring-suspended dancer roller which is arranged downstream of said second one of said plurality of deflecting rollers as considered in the direction of travel of the wrapping film.

8. The film delivery device as set forth in claim 1, wherein:

said first assembly comprises a film roll holder.

9. The film delivery device as set forth in claim 1, wherein:

said first assembly comprises a drive motor for rotating said first and second prestretch rollers.

10. The film delivery device as set forth in claim 1, further comprising:

a drive motor fixedly mounted upon said first assembly; and first transmission means for transmitting a driving force from said drive motor to said first prestretch roller.

11. The film delivery device as set forth in claim 10, wherein said first transmission means for transmitting a driving force from said drive motor to said first prestretch roller comprises:

a drive pulley disposed upon an upper end portion of said drive motor, a driven pulley disposed upon an upper end portion of said first prestretch roller; and a drive belt interconnecting said first and second drive and driven pulleys.

12. The film delivery device as set forth in claim 10, further comprising:

second transmission elements for transmitting said driving force from said first prestretch roller to said second prestretch roller.

13. The film delivery device as set forth in claim 12, wherein said second transmission elements for transmitting said driving force from said first prestretch roller to said second prestretch roller comprises:

a first cogwheel connected to an upper end portion of said first prestretch roller, and a second cogwheel connected to an upper end portion of said second prestretch roller, said first and second cogwheels adapted to be engaged with each other in a force-transmitting manner when said second assembly is disposed at said closed position, and to be disengaged from each other when said second assembly is disposed at said open position.

* * * * *